United States Patent [19]

Saunders

[11] Patent Number: 4,714,071

[45] Date of Patent: Dec. 22, 1987

[54] SLING ATTACHMENT TO AN ARCHERY BOW

[76] Inventor: Charles A. Saunders, 8380 - 36th Ave., Columbus, Nebr. 68601

[21] Appl. No.: 939,629

[22] Filed: Dec. 8, 1986

[51] Int. Cl.[4] ..... F41B 5/00

[52] U.S. Cl. ..... 124/88

[58] Field of Search ..... 124/23 R, 24 R, 86, 124/88, 89; 273/165, 166, 81 D; 224/221, 220, 219; 16/110 R, 125

[56] References Cited

U.S. PATENT DOCUMENTS

| | | | |
|---|---|---|---|
| 2,645,484 | 7/1953 | Hara | 273/166 |
| 3,055,354 | 9/1962 | Gates | 124/88 |
| 3,418,718 | 12/1968 | Current et al. | 124/23 R |
| 3,572,312 | 3/1971 | Foster | 124/88 |

OTHER PUBLICATIONS

Total Shooting Systems, Inc., Sharpshooter Bow Slings, p. 4.

Saunders Archery Company Catalog No. 66, Nu-Twist Sling, p. 3.

*Primary Examiner*—Richard C. Pinkham

*Assistant Examiner*—Benjamin Layno

*Attorney, Agent, or Firm*—Henderson & Sturm

[57] ABSTRACT

A sling for an archery bow of a conventional type having a handle, a pair of limbs extending in opposite directions from the handle and a bow string interconnecting the outer ends of the limbs. A generally U-shaped bracket is attached to a central portion of the front of the bow at a position just below the handle. An elongated member having a first and second end is attached to one end of the U-shaped member by being threaded through two spaced apart holes therein. The other end of the U-shaped member has a hole through which the elongated member is slidably received and a clip is attached to an intermediate portion of the U-shaped member for selectively holding the other end of the elongated member stationary with respect to the U-shaped bracket but allowing such other end to be quickly removed from the clip to allow such other end of the elongated member to slide in and out of the opening therein as desired.

5 Claims, 6 Drawing Figures

SLING ATTACHMENT TO AN ARCHERY BOW

TECHNICAL FIELD

The present invention relates generally to archery, and more particularly to a sling for archery bows.

BACKGROUND ART

When an archer tightly grasps the handle of an archery bow, this action typically causes the bow to move to one side or the other. It is well recognized in the archery field that the best form for shooting a bow is to have the hand in contact with the bow handle to be open, rather than to grasp the bow. A problem with the open handed form is that unless the bow is quickly grasped after an arrow is shot, the bow will spring forwardly out of the open hand and fall on the ground. Consequently, slings have been developed for the purpose of loosely wrapping around the wrist of the archer so that when the arrow is released, the bow will be prevented from jumping forwardly out of the hand of the archer even though the archer's hand is open.

The universal problem with prior art slings of the aforementioned type is that they need to be tight enough to prevent them from slipping off the wrist when the arrow is shot, but loose enough to facilitate taking them on or off of the wrist when the archer decides to use the bow or cease using the bow.

Consequently, there is a need to provide a sling for an archery bow which will overcome the aforementioned problems.

DISCLOSURE OF THE INVENTION

The present invention relates to a sling for an archery bow of a conventional type having a handle, a pair of limbs extending in opposite directions from the handle and a bow string interconnecting the outer ends of the limbs. A generally U-shaped bracket is attached to a central portion of the front of the bow at a position just below the handle. An elongated member having a first and second end is attached to one end of the U-shaped bracket by being threaded through two spaced apart holes therein. The other end of the U-shaped bracket has a hole through which the elongated member is slidably received and a clip is attached to an intermediate portion of the U-shaped bracket for selectively holding the other end of the elongated member stationary with respect to the U-shaped bracket but allowing such other end to be quickly removed from the clip to allow such other end of the elongated member to slide in and out of the opening therein as desired.

An object of the present invention is to provide an improved sling for an archery bow.

Another object of the present invention is to provide a sling for an archery bow which can quickly and easily be adjusted to be tighter or looser around the wrist of an archer.

A still further object of the present invention is to provide a sling for an archery bow which is simple to use, economical to construct and which is dependable in its use.

Other objects, advantages, and novel features of the present invention will become apparent from the following detailed description of the invention when considered in conjunction with the accompanying drawings.

BEST MODE FOR CARRYING OUT THE INVENTION

Figure 1:
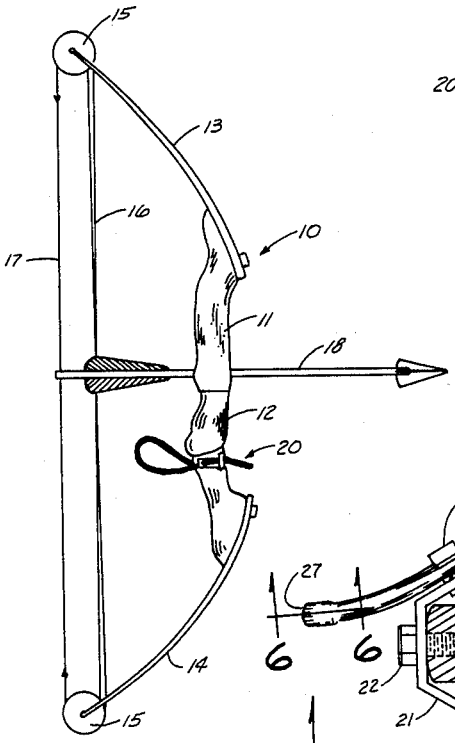
FIG. 1 is a side elevational view of a compound archery bow having a sling constructed in accordance with the present invention attached thereto.

Referring now to the drawings wherein like reference numerals designate identical or corresponding parts throughout the several views, FIG. 1 shows a bow (10) having a riser (11) thereon and a handle (12) connected to the riser (11). An upper limb (13) is attached to one end of the riser (11) and a lower flexible limb (14) is attached to the lower portion of the riser (11). Eccentric wheels (15) are rotatably attached to the extreme outer ends of the limbs (13 and 14) for receiving a cable (16) which has a bow string (17) attached to the ends thereof.

Referring to FIG. 1, it is noted that a sling apparatus (20) is attached to the riser (11) just below the handle (12). This sling (20) includes a U-shaped bracket (21) having a central opening therein which is held to the riser (11) by a bolt (22) extending into a threaded opening within the riser (11). Alternatively, an archery stabilizer of a well known type can be substituted instead of the bolt (22).

Figure 4:
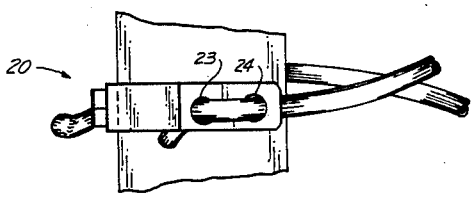
FIG. 4 is a partial enlarged scale elevational view taken along line 4—4 of FIG. 3.
Figure 6:
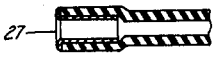
FIG. 6 is an enlarged partial cross sectional view taken along line 6—6 of FIG. 3.
Figure 3:
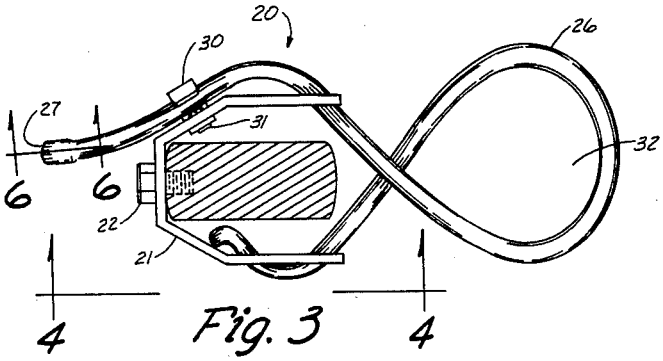
FIG. 3 is a cross sectional view taken along line 3—3 of FIG. 2.
Figure 2:
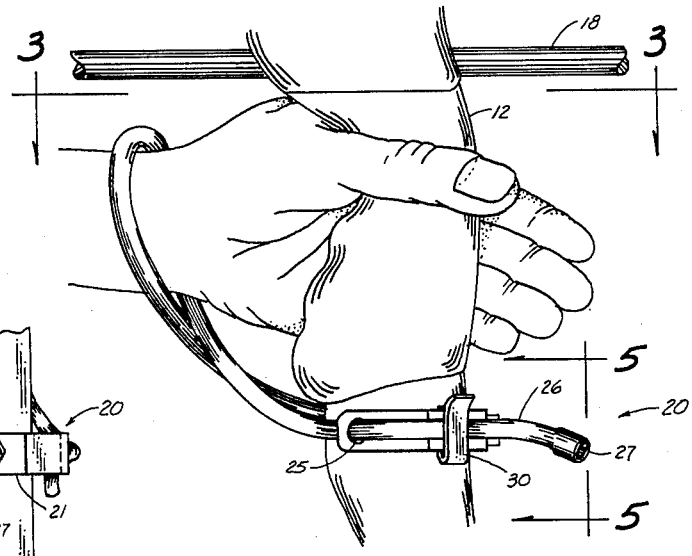
FIG. 2 is an enlarged partial side elevational view showing the sling of the present invention in use while an arrow is being shot from the bow.
Figure 5:
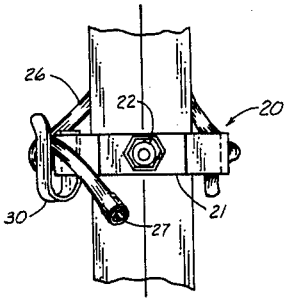
FIG. 5 is a view taken along line 5—5 of FIG. 2.

The bracket (21) has a pair of holes (23 and 24) in one end thereof and a single hole (25), shown in FIG. 2, in the other end thereof. An elastomeric, flexible, tubular member (26) which can be comprised of rubber, or plastic having similar properties to a flexible rubber hose, has one end thereof threaded through the openings (23 and 24) as shown in FIG. 4. The other end of the elongated elastomeric hose (26) is first threaded through the opening (25), as shown in FIG. 3, after a half twist configuration thereof has been made, as also shown in FIGS. 2 and 3. After the other end of the elongated elastomeric tube (26) has been placed through the opening (25), such end thereof is heated up slightly and then a metal insert member (27) is inserted therein to cause the extreme end of the elongated elastomeric tube (26) to be larger than the internal diameter of the hole (25). This will prevent the metal insert (27) and the end of the tubular member (26) having member (27) therein from passing back through the opening (25). This can save the archer much time because the tube never becomes unthreaded from the bracket hole (25).

A spring clip (30) has one side thereof on the inside of the U-shaped bracket (21) and a threaded fastener (31) extends through the metal spring clip (30) and threads into an internally threaded opening in the riser (11), inside of the U-shaped bracket (21).

In operation, to utilize the sling (20) of the present invention, an archer would first grasp the end having the metal insert (27) therein and pull it upwardly out of the clip (30), for example from the position shown in FIG. 3. Then the opening (32) formed by the elongated tube (26) can be made larger by pulling the member (26) through the opening (25). At that point, the archer's hand can be extended through the opening (32) to the position substantially shown in FIG. 2. Then the archer can use his other hand to pull the elongated elastomeric tube (26) back the other way through the opening (25) in the bracket (21) so as to tighten the member (26) around his wrist to a desired extent. Once the member (26) is tightened to the desired extent, the tube (26) would be pulled downwardly, with the archer's other hand, to the position shown in FIG. 2 wherein the member (26) would be held in such place by the spring clip (30). It is to be understood that the spring clip has some resilience and also that the elongated member (26) also has some resilience so they in combination hold the sling securely in place.

When it is desired to stop utilizing the bow (10), a reverse procedure is utilized wherein the end of the member (26) having the tube (27) therein is pulled upwardly out of the clip (30) and the archer's hand can be easily removed out through the opening (32) because the member (26) will easily slide through the opening (25) to enlarge the space (32) formed by the half twist or loop of the member (26).

Accordingly, it will be appreciated that the preferred embodiment shown herein does indeed accomplish the aforementioned objects. Obviously, many modifications and variations of the present invention are possible in light of the above teachings. It is therefore to be understood that, within the scope of the appended claims, the invention may be practised otherwise than as specifically described.

I claim:

1. A sling attachment for an archery bow of a type having a handle, a pair of limbs extending in opposite directions from said handle and a bow string interconnecting the outer ends of said limbs, said sling comprising:

a generally U-shaped bracket;

means for attaching a central portion of said U-shaped bracket to the front of said bow at a position just below said handle;

an elongated member having a first end and a second end;

first connecting means attached to one end of said U-shaped member for attaching said first end of said elongated member thereto, said first connecting means comprising two spaced apart holes extending therethrough, said one end of said elongated member extending through both of said holes;

second connecting means disposed on the other end of said U-shaped member, said second connecting means including an opening in the other end of said U-shaped member and having a portion of said elongated member slidably received through said opening; and clip means attached to an intermediate portion of said U-shaped member, between said opening and said attaching means, for selectively holding said other end of said elongated member stationary with respect to said U-shaped bracket.

2. The sling of claim 1 wherein said clip means comprises a U-shaped spring steel member extending around both sides and the bottom of said U-shaped bracket and having one end thereof secured to said U-shaped bracket, the other end of said U-shaped spring steel member being a free end spaced farther away from said handle than said one end thereof, the distance between said free end and said bracket being less than the diameter of said elongated member whereby said elongated member will be securely held stationary with respect to said clip means when engaged by said clip means but said elongated member will be free to slide in said opening when said elongated member is disengaged from said clip means.

3. The sling of claim 2 wherein said elongated member is an elastomeric hollow tube.

4. The sling of claim 3 including means disposed in said other end of said elastomeric hollow tube for expanding the other end of said elongated member so that it is larger than the size of the opening in the U-shaped bracket to thereby prevent said other end of the elongated member from passing out through the opening.

5. The sling of claim 4 wherein said elongated member has a half twist in it between the first and second connecting means.

* * * * *